United States Patent [19]

Werth et al.

[11] Patent Number: 4,522,458

[45] Date of Patent: Jun. 11, 1985

[54] ELECTRICAL CONNECTOR ASSEMBLY HAVING A FORCE ACTUATED RELEASING ARRANGEMENT

[75] Inventors: Dee A. Werth, Bainbridge; Vincent A. Luca, Jr., Sidney, both of N.Y.

[73] Assignee: Allied Corporation, Morristown, N.J.

[21] Appl. No.: 493,486

[22] Filed: May 11, 1983

[51] Int. Cl.[3] ..... H01R 13/62

[52] U.S. Cl. ..... 339/45 M; 339/80; 339/71

[58] Field of Search ..... 339/45, 46; 255/2; 403/2

[56] References Cited

U.S. PATENT DOCUMENTS

| | | | |
|---|---|---|---|
| 2,847,652 | 8/1958 | Kokalas | 339/45 M |
| 3,072,021 | 1/1963 | Marcon | 339/45 M |
| 3,195,097 | 7/1965 | McClain | 339/45 M |
| 3,553,912 | 1/1971 | Rogers | 403/2 |
| 3,609,632 | 9/1971 | Vetter | 339/14 R |
| 3,887,257 | 6/1975 | Panek et al. | 339/45 M |
| 3,953,098 | 4/1976 | Avery et al. | 339/45 R |
| 4,136,919 | 1/1979 | Howard | 339/75 P |
| 4,138,181 | 2/1979 | Hacker | 339/45 R |
| 4,166,664 | 9/1979 | Herrmann | 339/91 R |
| 4,279,458 | 7/1981 | Knapp | 339/45 M |

*Primary Examiner*—Gil Weidenfeld
*Assistant Examiner*—David L. Pirlot
*Attorney, Agent, or Firm*—C. D. Lacina

[57] ABSTRACT

A frangible pin (15) extends radially between interfitted first and second shell portions (21, 26) comprising an electrical connector assembly, the pin having a cross-sectional area sized to shear upon application of an external force so that the shells can break-away from one another.

2 Claims, 4 Drawing Figures

ELECTRICAL CONNECTOR ASSEMBLY HAVING A FORCE ACTUATED RELEASING ARRANGEMENT

This invention relates to an electrical connector assembly having a force actuated releasing arrangement.

Electrical connector assemblies comprising a pair of connectors and a coupling arrangement which couples and releases the connectors from mated relation either by rotation of the coupling or by an external lanyard load applied to the coupling and transmitted to the connection are known. A "Releasing Electrical Connector", U.S. Pat. No. 4,279,458 issuing July 21, 1981 to Knapp, shows a receptacle adapted to mount to a bulkhead or a bomb rack and mated with a plug carrying a force dependent coupling arrangement of the type including a retracting operating sleeve and a plurality of threaded segments which connect to thread on the receptacle such that an external pull force applied to the coupling is transmitted to the thread whereupon the segments are cammed radially outward and the assembly disconnected. While this design has been found to be quite acceptable, if for any reason the operating sleeve does not retract and/or the segments do not disengage, such as in environments where water and cold temperatures are present and ice forms to prevent the segments or sleeve from functioning, the external force required by the lanyard to actuate release would increase. In a worst case, the external force could break the lanyard but the plug and receptacles would not separate as required. Accordingly, it would be desirable to have a releasable electrical connector assembly having redundant means for assuring that connector components would always release upon application of an external force of predetermined value.

A releasable electrical connector assembly comprises plug and receptacle components and a force actuated releasing arrangement, the force actuated releasing arrangement connecting the two shells together. One of the plug or receptacle components is characterized by separable first and second shells of and a size such that an end portion of the second shell interference fit within an end portion of the first shell to form a connector assembly. The releasing arrangement comprises a frangible pin disposed in a hole extending through the first shell and interference fit in a recess counter-bored into the second shell, the pin having a cross-sectional area of a size adapted to shear upon application of an external force of a predetermined magnitude whereupon the shells break-away from one another. In another aspect the separable component is one of the two mating electrical connectors of a releasing connector having a coupling arrangement wherein an operating sleeve is circumposed about one of the connectors for rearward releasing movement in response to an external force of a second and lesser predetermined magnitude, the two predetermined forces assuring that the frangible pin breaks away only if the operating sleeve does not retract and actuate release.

An advantage of the releasable electrical connector according to this invention is a redundant force actuated coupling arrangement which will absolutely release in any environment upon attainment of either of two external forces placed on the interconnection.

One way of carrying out the invention is described below with reference to the drawings which illustrate one specific embodiment of this invention, in which.

Figure 1:
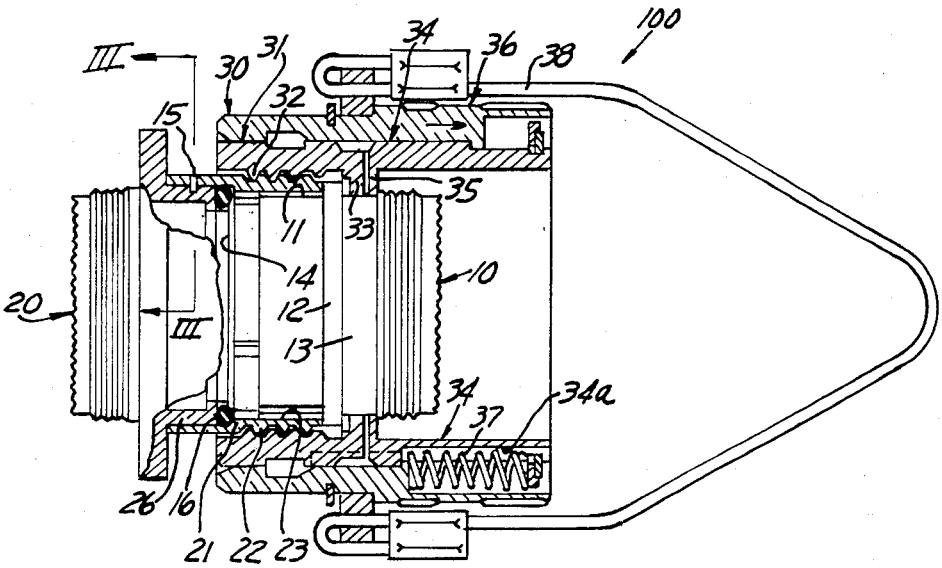
FIG. 1 is an electrical connector assembly according to the present invention in partial longitudinal section.

Referring now to the drawings, FIG. 1 shows an electrical connector assembly 100 comprising interengageable plug and receptacle components 10, 20 and a force actuated releasing arrangement 30. Receptacle component 20 includes a generally cylindrical shell 21 having an outer periphery thereof provided with thread 22 and an interior wall 23. Plug component 10 includes an exterior periphery 11 and an end face 14 sized to telescope within the receptacle, a medial annular flange 12 and an annular groove 13. The force actuated releasing arrangement 30 is carried on plug component 10 and comprises: a plurality of arcuate segments 31 each having an internal thread feature 32 and an inwardly directed flange portion 33; a pair of cylindrical spring retainer housings 34 each having a spring cavity **34*a* and an inwardly directed flange portion 35; an exterior operating sleeve 36; a compression spring 37 disposed in each spring cavity 34*a* of spring retainer housing 34 for constantly biasing the operating sleeve 36 forwardly whereby the arcuate segments 31 are driven radially inward; and a lanyard cable 38 mounted to the exterior of operating sleeve 36 for transmitting external releasing forces to the interconnection, the flange portions 33, 35 being arranged annularly of annular flange 12 and within annular groove 13**. For details of coupling/uncoupling operation of the force actuated releasing arrangement, refer to the aforementioned U.S. Pat. No. 4,279,458 specifically incorporated herein by reference.

Preferably and in accord with this invention, receptacle component 20 comprises a pair of generally cylindrical, coaxially disposed, shells 21, 26 and a frangible pin 15 extending therebetween to connect the shells together.

An annular moisture seal 16 is disposed within outer shell 21 and forward of inner shell 26 and adapted to be compressed by end face 14 of the plug component to seal against moisture penetration about inner wall 23 of outer shell 21. To enhance resistance to entry of moisture, inner and outer shells 26, 21 are adapted to interference fit together.

Figure 2:
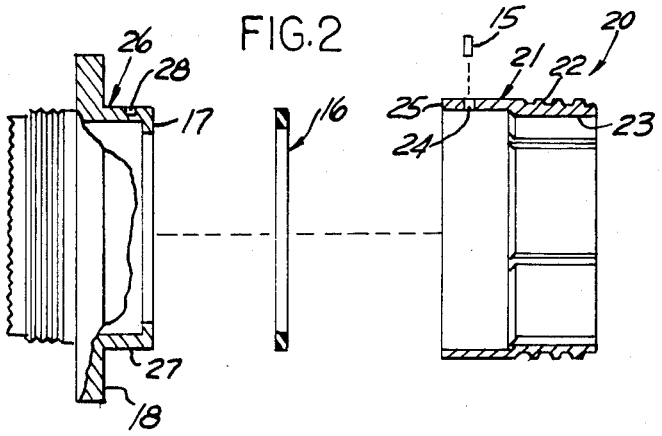
FIG. 2 is an exploded perspective view in section of a receptacle component shown in FIG. 1.

FIG. 2 shows a side view of receptacle component 20 in an exploded relation and partially in section and comprises inner shell 21, outer shell 26, elastomeric moisture seal 16 and frangible pin 15. Outer shell 21 includes an opening 24 extending therethrough and a transverse rear face 25. Inner shell 26 includes a transverse front face 17, an outer periphery 27, a mounting flange defining a shoulder 18 and a recess 28 counterbored into its outer periphery, recess 28 and opening 24 being generally radially extending with each being adapted to be brought into register with one another when outer shell 21 is fit over inner shell 26 and transverse end face 25 abutted against shoulder 18. Pin 15 is sized to interference fit opening 24 and interference fit recess 28 for unwanted non-removability therefrom.

Figure 3:
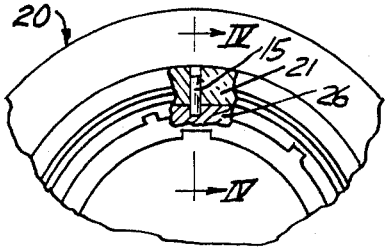
FIG. 3 is an end view partially in section taken along lines III—III of FIG. 1.

FIG. 3 shows frangible pin 15 extending between the inner and outer shells 26, 21 of receptacle component 20.

Figure 4:
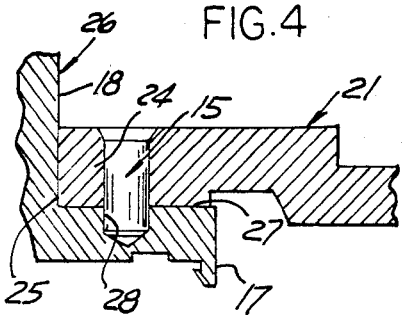
FIG. 4 is an enlarged view in section taken along lines IV—IV of FIG. 3.

FIG. 4 shows frangible pin 15 having its ends extending between the shells with one end being interference fit within the recess 28 and the other end interference fit in opening 24.

Although many materials possibly could be selected, preferably receptacle shells 21, 26 and frangible pin 15 are comprised of aluminum (e.g. AMS 4150). Preferably a plurality of pins would be disposed around the shells with three pins equiangularly disposed therearound providing a uniform distribution of axial loads onto each of the interfitted shells. An analysis of the force required to break the lanyard cable versus the force required to break the pin and/or pins will determine the cross-sectional diameter of pins, material and number required in each unit.

In operation when the mated assembly is interconnected and a first external axial force is applied to the lanyard, if ice has formed and the interconnection does not release, a second and greater external force is applied to the lanyard which is of a magnitude sufficient to shear the frangible pins and allow the receptacle sleeves to separate and the plug to disconnect from the receptacle, the second external force being of a magnitude less than that necessary to break the lanyard.

While it has been noted that receptacle component 20 comprises the interfitting shells, equally so the plug component 10 could be comprised of interfitting sleeves which are also frangible.

We claim:

1. An electrical connector assembly including a force actuated releasing arrangement, said electrical connector assembly comprising interconnected plug and receptacle components and said force actuated releasing arrangement releasably connecting said components together and comprising coaxial sleeves carried about said plug component with one of said sleeves being connected to the receptacle component and adapted to move radially and disconnect therefrom upon application of a first external axial force and another of said sleeves being adapted to move longitudinally of said one sleeve upon application of said first external axial force, said force actuated releasing arrangement further characterized by:

one of said components comprising a pair of generally cylindrical shell portions interfitted with one another and a pin extending between the shell portions and having its opposite ends received, respectively, in the two shell portions, said pin having a cross-sectional area adapted to shear upon application of a second external axial force, said second external axial force being greater than said first external axial force.

2. The connector assembly as recited in claim 1 wherein said one component is said receptacle component and said coaxial sleeves are disposed in said plug component.

* * * * *